US009351370B2

(12) United States Patent
Malinin et al.

(10) Patent No.: US 9,351,370 B2
(45) Date of Patent: May 24, 2016

(54) MODIFYING DUTY CYCLES OF PWM DRIVE SIGNALS TO COMPENSATE FOR LED DRIVER MISMATCHES IN A MULTI-CHANNEL LED SYSTEM

(71) Applicant: Dialog Semiconductor Inc., Campbell, CA (US)

(72) Inventors: Andrey B. Malinin, Fort Collins, CO (US); Enzhu Liang, Pacifica, CA (US); Yuwen Wang, Hayward, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 0 days.

(21) Appl. No.: 14/485,118

(22) Filed: Sep. 12, 2014

(65) Prior Publication Data

US 2015/0076999 A1 Mar. 19, 2015

Related U.S. Application Data

(60) Provisional application No. 61/878,535, filed on Sep. 16, 2013.

(51) Int. Cl.
*H05B 33/08* (2006.01)
*H05B 41/285* (2006.01)

(52) U.S. Cl.
CPC ..... *H05B 33/0887* (2013.01); *H05B 33/0815* (2013.01); *H05B 33/0827* (2013.01); *H05B 33/0866* (2013.01); *H05B 41/2851* (2013.01)

(58) Field of Classification Search
CPC ..... H05B 33/0815; H05B 33/0845; H05B 37/02; H05B 33/0884; H05B 37/03; H05B 41/2851; H05B 41/2855; H05B 41/2858; H05B 41/2985; H05B 41/3927; H05B 3/0815
USPC ..... 315/247, 185 S, 291, 307–326
See application file for complete search history.

(56) References Cited

U.S. PATENT DOCUMENTS

| | | | | |
|---|---|---|---|---|
| 7,880,400 | B2 * | 2/2011 | Zhou et al. | 315/247 |
| 8,044,609 | B2 * | 10/2011 | Liu | 315/291 |
| 8,288,953 | B1 * | 10/2012 | Mei | 315/209 R |
| 2007/0108846 | A1 | 5/2007 | Ashdown | |
| 2008/0048582 | A1 | 2/2008 | Robinson | |
| 2010/0289424 | A1 | 11/2010 | Chang et al. | |
| 2011/0248648 | A1 * | 10/2011 | Liu | 315/294 |
| 2012/0169245 | A1 | 7/2012 | Chen | |
| 2013/0082624 | A1 | 4/2013 | Brassfield et al. | |

OTHER PUBLICATIONS

PCT International Search Report and Written Opinion, PCT Application No. PCT/US14/55692, Nov. 24, 2014, 15 pages.

* cited by examiner

*Primary Examiner* — Tuyet Vo

(74) *Attorney, Agent, or Firm* — Fenwick & West LLP

(57) ABSTRACT

An LED (Light Emitting Diode) controller comprises a first LED driver to generate a first PWM (Pulse Width Modulation) drive signal to turn on or turn off, respectively, a first current through a first LED string. Additionally, the LED controller comprises a compensation circuit to generate the first PWM drive signal responsive to a first duty set signals. The first duty set signal is indicative of a first duty cycle set for the first PWM drive signal. The compensation circuit receives a first feedback signal indicative of the first current, generates a first error signal indicative of a difference between a first predetermined target value and the first feedback signal, and generates the first PWM drive signal to have the first duty cycle corresponding to the first duty set signal and further adjusted by the first error signal.

16 Claims, 6 Drawing Sheets

MODIFYING DUTY CYCLES OF PWM DRIVE SIGNALS TO COMPENSATE FOR LED DRIVER MISMATCHES IN A MULTI-CHANNEL LED SYSTEM

CROSS-REFERENCE TO RELATED APPLICATION

This application claims priority under 35 U.S.C. §119(e) from U.S. Provisional Patent Application No. 61/878,535, entitled "Feedback Configurations to Compensate for Driver Mismatches in a Multi-String LED System," filed on Sep. 16, 2013, which is incorporated by reference herein in its entirety.

BACKGROUND

1. Technical Field

The present disclosure relates generally to a multi-string LED (light-emitting diode) system and, more specifically, to feedback configurations for brightness matching in multi-string LED systems.

2. Description of the Related Arts

LEDs are used in a wide variety of electronics applications, for example, architectural lighting, automotive head and tail lights, backlights for liquid crystal display devices including personal computers and high definition TVs, flashlights, and the like.

LEDs are current-driven devices, and thus regulating the current through the LEDs is an important control technique. In Liquid Crystal Display (LCD) applications using LED backlights, it is often necessary for a controller to control several strings of LEDs with independent current settings for each string. The controller can then independently control the brightness of different sections of the LCD.

SUMMARY

Some applications of multi-string LED systems (e.g., in LCD displays) benefit from illuminating one or more LED strings of the multiple LED channels at a substantially matched or equal level of brightness (e.g., matched within a predefined matching threshold, such as within 1% brightness matching). For example, maintaining a uniform level of brightness across the LED strings that constitute rows or columns of pixels of an LCD display provides an improved aesthetic quality and viewability to the LCD display.

In order to provide a desired level of brightness for an LED string and optionally a desired level of brightness matching between LED strings, the controller in the multi-string LED system needs to maintain a target (e.g., uniform) and optionally matched level of average current between the one or more LED strings of the multi-string LED system. Conventional LED controllers are limited in their ability to provide such current matching owing to mismatches between drivers, within the controllers, that provide control signals to each of the one or more LED strings.

In one or more embodiments, an LED (Light Emitting Diode) controller comprises a first LED driver to generate a first PWM (Pulse Width Modulation) drive signal to turn on or turn off a first current through a first LED string responsive to the first PWM drive signal. The LED controller further comprises a first compensation circuit to generate the first PWM drive signal responsive to a first duty set signal, the first duty set signal indicative of a first duty cycle set for the first PWM drive signal. The first compensation circuit comprises a first error determination circuit to receive a first feedback signal indicative of the first current and to generate a first error signal indicative of a difference between a first predetermined target value and the first feedback signal. The first compensation circuit further comprises a first PWM signal generation circuit to generate the first PWM drive signal to have the first duty cycle corresponding to the first duty set signal and further adjusted by the first error signal.

In some embodiments, the first predetermined target value corresponds to a target average current value for the first current and the first feedback signal represents a measured average current value corresponding to the first current. In alternative embodiments, the first predetermined target value corresponds to the value of the first duty set signal and the first feedback signal represents a measured duty cycle value of the first current.

In one or more embodiments, the LED controller further comprises a second LED driver to generate a second PWM drive signal to turn on or turn off a second current through a second LED string responsive to the second PWM drive signal. The LED controller further comprises a second compensation circuit to generate the second PWM drive signal responsive to a second duty set signal, the second duty set signal indicative of a second duty cycle set for the second PWM drive signal. The second compensation circuit comprises a second error determination circuit to receive a second feedback signal indicative of the second current and to generate a second error signal indicative of a difference between a second predetermined target value and the second feedback signal. The second compensation circuit further comprises a second PWM signal generation circuit to generate the second PWM drive signal to have the second duty cycle corresponding to the second duty set signal and further adjusted by the second error signal.

In one or more embodiments, the first error determination circuit generates the first error signal during a first switching cycle of the first PWM drive signal. For a second switching cycle subsequent to the first switching cycle, based on the first error signal generated during the first switching cycle: the PWM signal generation circuit decreases the first duty cycle with respect to the first duty set signal, if the first feedback signal generated during the first switching cycle exceeds the predetermined target value, and the PWM signal generation circuit increases the first duty cycle with respect to the first duty set signal, if the first feedback signal generated during the first switching cycle is less than the predetermined target value.

In one or more embodiments, the first LED driver operates at a first speed of operation, and the second LED driver operates at a second speed of operation, the second speed greater than the first speed. In such embodiments, the first duty cycle of the first PWM drive signal is adjusted with respect to the first duty set signal to be greater than the second duty cycle of the second PWM drive signal adjusted with respect to the second duty set signal.

In one or more embodiments, a method of driving a multi-channel LED system comprises generating a first PWM (Pulse Width Modulation) drive signal to turn on or turn off a first current through a first LED string responsive to the first PWM drive signal, the first PWM drive signal responsive to a first duty set signal indicative of a first duty cycle set for the first PWM drive signal. In some embodiments, generating the first PWM signal comprises: receiving a first feedback signal indicative of the first current through the first LED string, generating a first error signal indicative of a difference between a first predetermined target value and the first feedback signal, and generating the first PWM drive signal to have the first duty cycle corresponding to the first duty set signal and further adjusted by the first error signal.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The figures and the following description relate to preferred embodiments of the present disclosure by way of illustration only. It should be noted that from the following discussion, alternative embodiments of the structures and methods disclosed herein will be readily recognized as viable alternatives that may be employed without departing from the principles of the disclosure.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
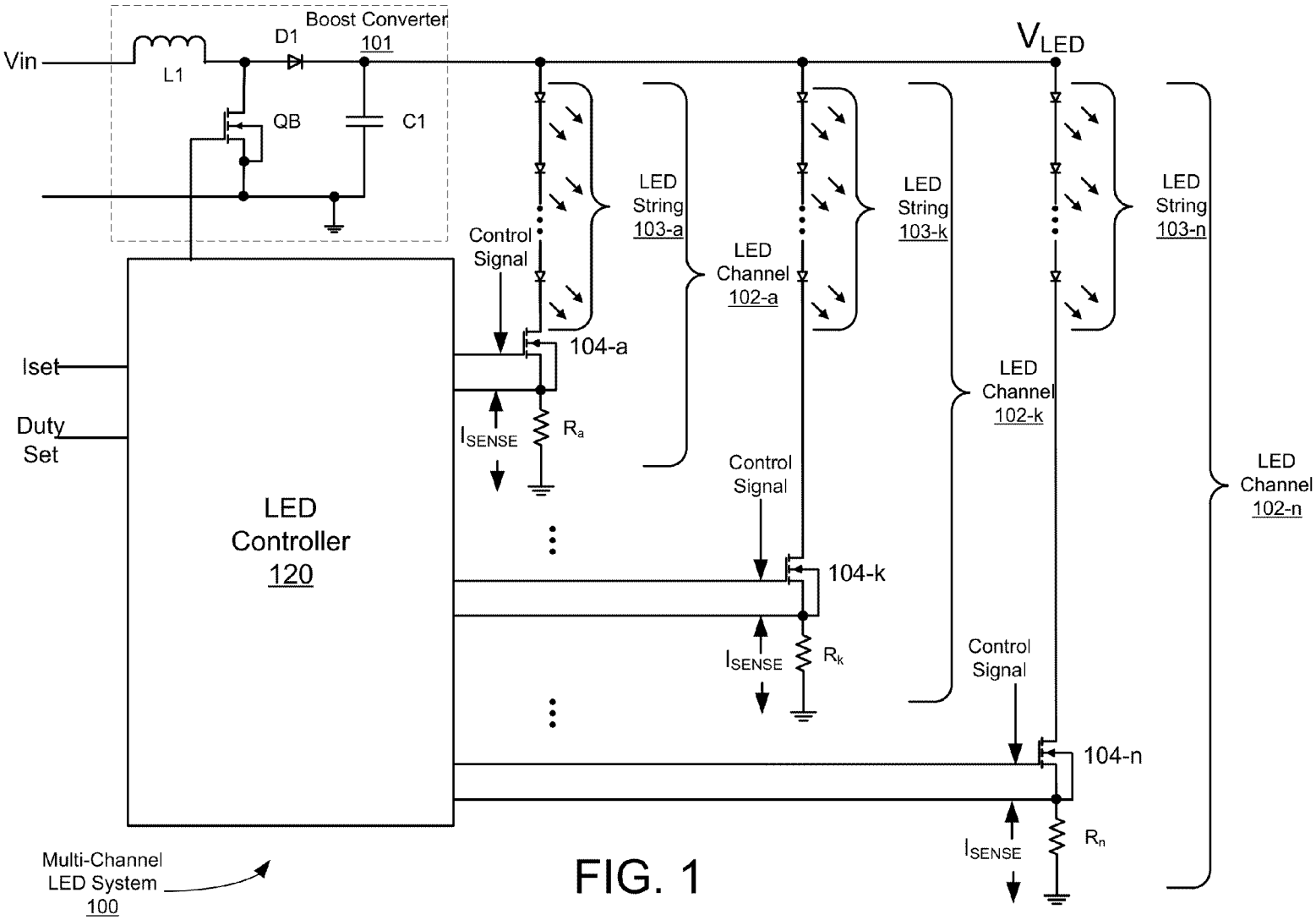
FIG. 1 illustrates a multi-channel LED system, according to one embodiment.

FIG. 1 illustrates a multi-channel LED system 100, according to one embodiment. Multi-channel LED system 100 comprises a DC-DC power converter 101 (e.g., Boost Converter), multiple LED channels 102, and a LED controller 120.

DC-DC Converter (Boost Converter)

To drive a large array of LEDs from a direct current (DC) voltage source (which can result from rectification of AC voltage), DC-DC switching power converters such as boost or buck-boost power converters are often used to provide a supply voltage to appropriately bias several strings of LEDs. As shown in FIG. 1, boost converter 101 receives an input voltage Vin and provides regulated voltage ($V_{LED}$) to the multiple LED channels 102. In one embodiment, boost converter 101 comprises inductor L1, diode D1, capacitor C1, and switch $Q_B$ (e.g., an NMOS transistor). The switching mechanism (e.g., frequency or duty cycle of switching) of switch $Q_B$ is controlled by LED controller 120. This control mechanism enables boost converter 101 to maintain $V_{LED}$ at a programmed level set by LED controller 120. In one embodiment, LED controller 120 senses the voltage $V_{LED}$ (or a representation of $V_{LED}$) in order to perform feedback control to maintain $V_{LED}$ at the programmed level.

When switch $Q_B$ turns on, diode D1 becomes reverse biased, and the input power received from a source of the supply voltage Vin is stored in inductor L. On the other hand, when switch $Q_B$ turns off, diode D1 becomes forward biased and the input power is transferred to the capacitor C1, thus charging capacitor C1 and providing voltage $V_{LED}$ to power the multiple LED channels 102. The output voltage $V_{LED}$ applied to the LED channels 102 provides current through the LED channels 102.

LED Channels

As shown in FIG. 1, multiple LED channels 102 (e.g., including LED channel 102-*a*, LED channel 102-*k*, LED channel 102-*n* and the like) are connected in parallel with each other (e.g., between voltage $V_{LED}$ and a voltage ground). Each LED channel 102 comprises, respectively, a series connection of an LED string 103 (including LED strings 103-*a*, 103-*k*, . . . , 103-*n*), a PWM transistor 104 (including transistors 103-*a*, 104-*k*, . . . , 104-*n*) (e.g., an n-type MOSFET), and a sense resistor R (Ra, Rk, . . . , Rn).

Each LED string 103 comprises a series connection of a plurality of LEDs. The output voltage $V_{LED}$ of boost converter 101 is coupled to the anode of a first LED in each LED string 103. The cathode of a last LED in each LED string 103 for a given LED channel 102 is coupled to the drain of the PWM transistor 104 of that given LED channel 102. The source of the PWM transistor 104 is connected to one terminal of the sense resistor R for that given LED channel 102 and the other terminal of the sense resistor R is connected to the voltage ground.

Current through the sense resistor R (e.g., indicative of current through the respective LED string 103) of a given LED channel 102 is sensed as a voltage drop ($I_{SENSE}$) across the sense resistor R for that LED channel 102 and is provided as a feedback signal to LED controller 120. The LED controller 120, in turn, generates a control signal that drives the gate terminal of the PWM transistor 104 for that given LED channel 102 in order to control current through that LED channel 102, and consequently, the brightness of LED string 103 of that LED channel 102. Although FIG. 1 illustrates only three LED channels, multi-channel LED system 100 can include any number of LED channels 102 (e.g., 9 LED channels) and corresponding control/regulation circuitry.

LED Controller

As described above, LED controller 120 regulates voltage $V_{LED}$ to a desired set point voltage in order to power the multiple LED channels 102. Accordingly, LED controller 120 controls the switching (e.g., frequency or duty cycle of switching) of switch $Q_B$ of the boost converter 101. LED controller 120 can employ any one of a number of well-known modulation techniques, such as pulse-width-modulation (PWM) or pulse frequency-modulation (PFM), to control the on and off states and duty cycles of switch $Q_B$. PWM and PFM are conventional techniques used for controlling the switching power converters by controlling the widths or frequencies, respectively, of an output drive pulse driving the switch $Q_B$ to achieve regulation of voltage $V_{LED}$.

Additionally, LED controller 120 provides control signals individually to each of the LED channels 102 to regulate brightness of and match brightness between LED strings 103 of the multiple LED channels 102. Toward this end, as described above, LED controller 120 senses current through the sense resistor R (e.g., indicative of current through the respective LED string 103) for each LED channel 102 as a voltage drop ($I_{SENSE}$) across the sense resistor R for that LED channel 102, and generates a control signal that drives the gate terminal of the PWM transistor 104 for the respective LED channel 102 in order to control current through (e.g., and consequently, brightness of) the corresponding LED string 103.

In some embodiments, PWM transistor 104 for a given LED channel 102 receives a Pulse Width Modulation (PWM) control signal from the LED controller 120 in order to control an average current through and brightness of LED string 103 for that LED channel 102 according to a duty cycle of the PWM control signal.

In some embodiments, as shown in FIG. 1, LED controller 120 receives signals Iset and Duty Set. The signal Iset specifies a target (e.g., desired or set point) voltage drop across sense resistor R corresponding to a target peak current level to be achieved for each LED channel 102 during an on state of the respective PWM transistor 104 for each LED channel 102. Similarly, the signal Duty Set specifies a target (e.g., desired) duty cycle to be achieved for each LED channel 102 for switching of the respective PWM transistor 104. The same signals Iset and Duty Set are provided to all LED channels 102 to provide the same target value of peak current and duty cycle to all LED channels 102.

Target average current through each LED channel 102 for a given PWM cycle is a product of the target value of peak current through the LED channel 102 during that switching cycle and the target duty cycle of switching of the PWM transistor 104 for the LED channel 102 for that switching cycle. LEDs are current controlled devices; the brightness of the LED string 103 for a given LED channel 102 is a function of average current through that LED channel 102. Thus, by controlling average current through each LED channel to the product of Iset and Duty Set, via the feedback configurations described below (e.g., FIG. 3 and FIG. 4), brightness controller 120 matches the brightness between LED strings 103 to a substantially equal level of brightness (e.g., within a predetermined brightness matching range, such as within 1%, 2%, 5%, or the like).

LED Controller Architectures for Brightness Control

Figure 2A:
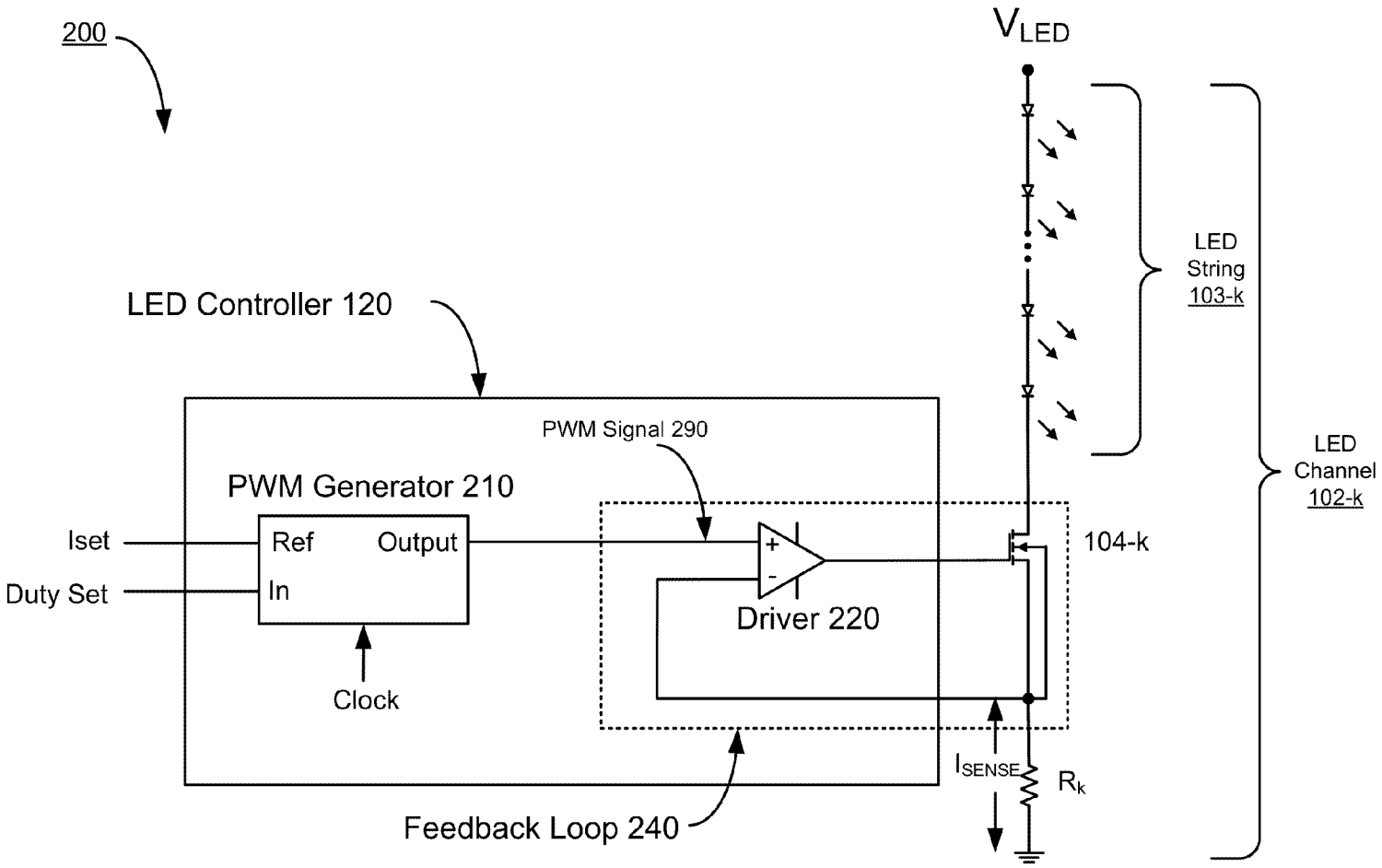
FIG. 2A illustrates a conventional feedback configuration for controlling brightness of an LED string of a multi-channel LED system.

FIG. 2A illustrates a conventional feedback configuration 200 for controlling brightness of an LED string of a multi-channel LED system. As shown in the configuration 200 in FIG. 2A, LED controller 120 comprises PWM Generator 210 (alternatively referred to herein as a PWM generation circuit) and a driver 220 corresponding to each LED channel 102. Although FIG. 2A illustrates a feedback configuration (including PWM Generator 210 and driver 220) for one LED channel (LED channel 102-*k*), in practice and as described with reference to FIG. 2B, the LED controller 120 may include an independent and separate set of feedback components for each of the LED channels 102 (e.g., including LED channel 102-*a*, LED channel 102-*k*, LED channel 102-*n* and the like) present in the multi-string LED system 100. LED controller 120 regulates current through the LED string 103-*k* according to programmed current and duty cycle levels (e.g., specified by Iset and Duty Set signals) for LED channel 102-*k*.

Accordingly, PWM Generator 210 receives signals Iset and Duty Set at reference (Ref) and input (In) terminals, respectively, of the PWM Generator 210 and generates a PWM signal 290 at output terminal (Out) of the PWM Generator 210.

Driver 220 is optionally an operational amplifier (op-amp). The output of driver 220 is coupled to the gate of PWM transistor 104-*k* to control current through the LED channel 102-*k*. Driver 220 receives PWM signal 290 from PWM Generator 210 at the non-inverting terminal and receives signal $I_{SENSE}$ at the inverting terminal via a feedback loop from the source of PWM transistor 104-*k*. A feedback loop 240 is thus formed to sense the current through the LED string 103-*k* via voltage $I_{SENSE}$ and to provide a control signal to the gate of the PWM transistor 104-*k* in order to generate voltage $I_{SENSE}$ at the source of the PWM transistor 104-*k* that follows the PWM signal 290.

Figure 5A:
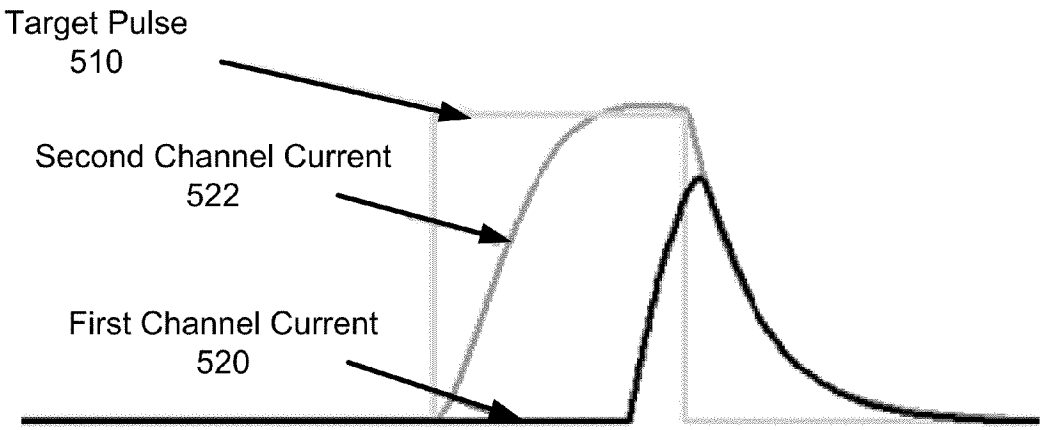
FIGS. 5A-5B illustrate comparative time traces of currents through two different LED strings of the multi-channel LED system without feedback regulation (FIG. 5A) and with feedback regulation (FIG. 5B), according to some embodiments.

However, driver 220 may be limited in its ability (e.g., speed of operation, as characterized by limited slew rate, input-to-output propagation delay time, and so on) to provide a control signal at the gate of the PWM transistor 104-*k* that enables $I_{SENSE}$ to adequately follow the PWM signal 290. In some cases, an impact of a slow driver is particularly pronounced at lower duty cycles (e.g., lower than 1%) and affects the ability of voltage signal $I_{SENSE}$, or its corresponding current waveform to follow a target PWM pulse of the PWM signal 290. For example, as shown in FIG. 5A, a first channel current 520 (corresponding to measured voltage $I_{SENSE}$) that is intended to follow a target PWM pulse 510 has a delayed rise time, a slower rise time, an inability to reach a target set point voltage or current value (owing to the slower rise time), and a delayed fall time, relative to the target PWM pulse 510. Inability of a channel current to follow a target PWM pulse results in the average current for that channel during that PWM cycle being lower than a desired or target average current value. This, in turn, results in a brightness of the LED string for that channel being lower than a desired brightness.

Furthermore, characteristics of driver 220 that drive different LED channels 102 may vary across the LED channels 102.

Figure 2B:
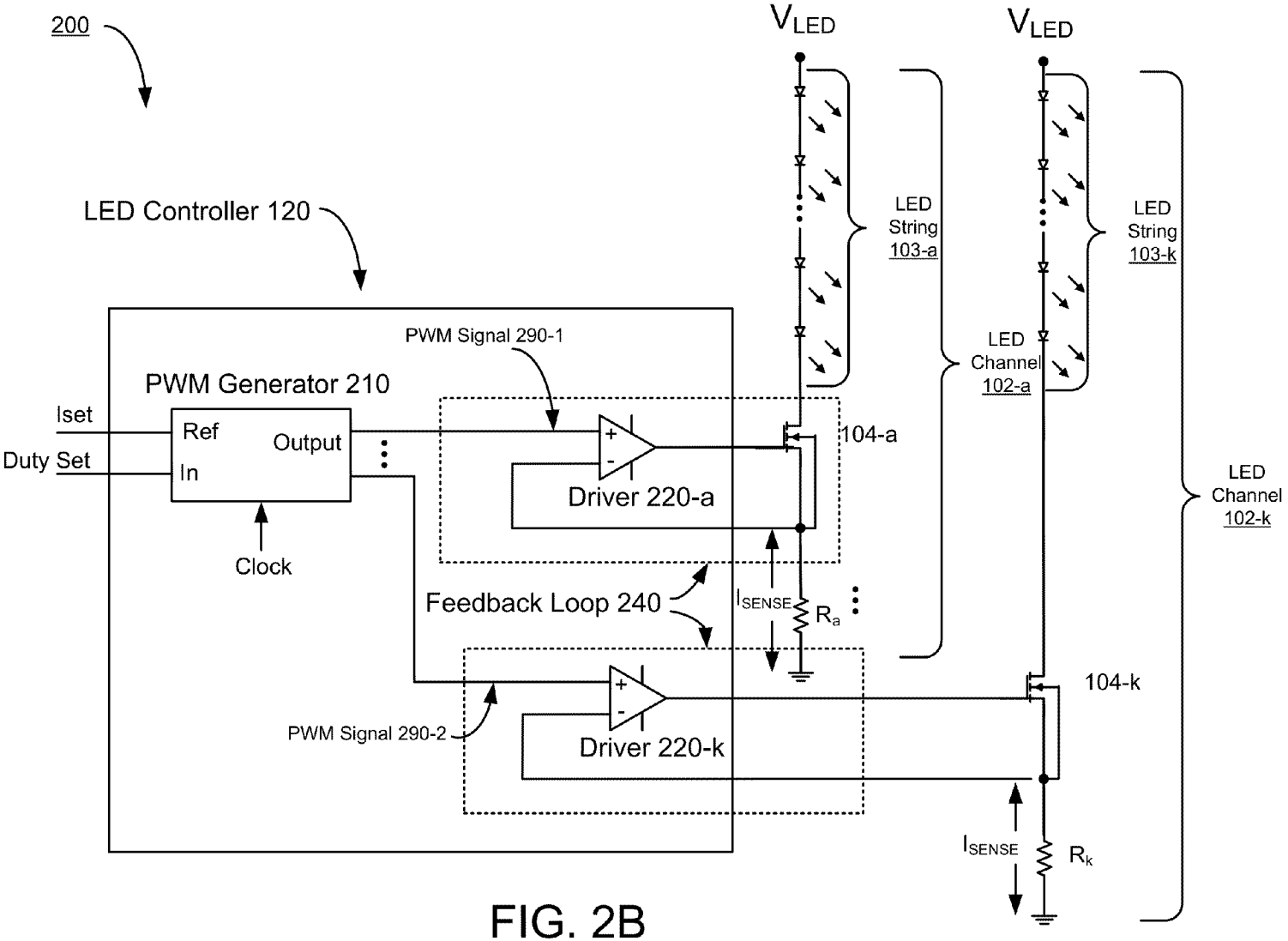
FIG. 2B illustrates the conventional feedback configuration of FIG. 2A for controlling the brightness of a plurality of LED strings of a multi-channel LED system.

For example, FIG. 2B illustrates the conventional feedback configuration 200 of FIG. 2A for controlling brightness of two LED strings 103-*a* and 103-*k* of the same multi-channel LED system. In this example, consider that driver 220-*a* that drives LED channel 102-*a* is slower than driver 220-*k* that drives LED channel 102-*k*. Faster drivers are able to follow a target PWM pulse more closely than slower drivers. Illustrated graphically, as shown in the waveforms of FIG. 5A, a driver that drives the first channel of FIG. 5A (e.g., driver 220-*a* of FIG. 2A) is slower in speed of operation than a driver that drives the second channel of FIG. 5A (e.g., driver 220-*k* of FIG. 2A). As illustrated in first and second channel current waveforms 520 and 522 of FIG. 5A, these differential driver speeds impact, to different extents, the LED drivers from being able to follow the same target PWM pulse. This, in turn, results in a higher average current through LED strings driven by faster drivers than the average current through LED strings by slower drivers, particularly at lower duty cycles. And this, in turn, results in a greater brightness of LED strings driven by faster drivers than LED strings driven by slower drivers. Thus, differential driver operating speeds impact brightness matching across LED strings.

Stated differently, variations or mismatches between drivers (e.g., differential driver operation speeds) in configuration 200 result in mismatched current waveforms across the LED channels (see, for example, the discrepancies between first channel current 520 and second channel current 522 illustrated in FIG. 5A). This mismatch in current waveforms through the LED channels results in channel-to-channel current mismatch across LED channels 102 and, consequently, results in insufficient brightness matching across LED strings 103. A drawback of this conventional configuration 200 is that an impact of these driver mismatches on channel currents are neither measured, nor nulled, nor otherwise compensated for, thus resulting in poor current and brightness matching across LED strings 103.

LED Controller Feedback Configurations for Brightness Matching Across LED Strings Based on Duty Cycle Feedback In order to provide a desired level of brightness matching between the one or more LED strings, the controller in the multi-string LED system needs to maintain a uniform and matched level of average current between the one or more LED strings of the multi-string LED system.

To overcome the limitations associated with driver mismatches in LED controllers (such as those illustrated in FIGS. 2A and 2B), embodiments herein provide a feedback configuration, in the multi-channel LED system, that compensates for such driver mismatch by adjusting a duty cycle of a pulse width modulated (PWM) LED drive signal that is received by the driver for switching on or off a corresponding LED string of the one or more LED strings. This adjustment to duty cycle of the LED drive signal for a channel is made based on an error or discrepancy between a measured duty cycle of the LED current through that channel (impacted by the driver characteristics) and a desired set point or target value of duty cycle of LED current that needs to be maintained for that channel. By adjusting the duty cycle of the drive signal to reduce the error between measured and target duty cycle of the LED current to a substantially zero value across the one or more channels, the measured duty cycles of LED currents through the one or more LED channels are matched, resulting in channel-to-channel current and brightness matching.

Figure 3:
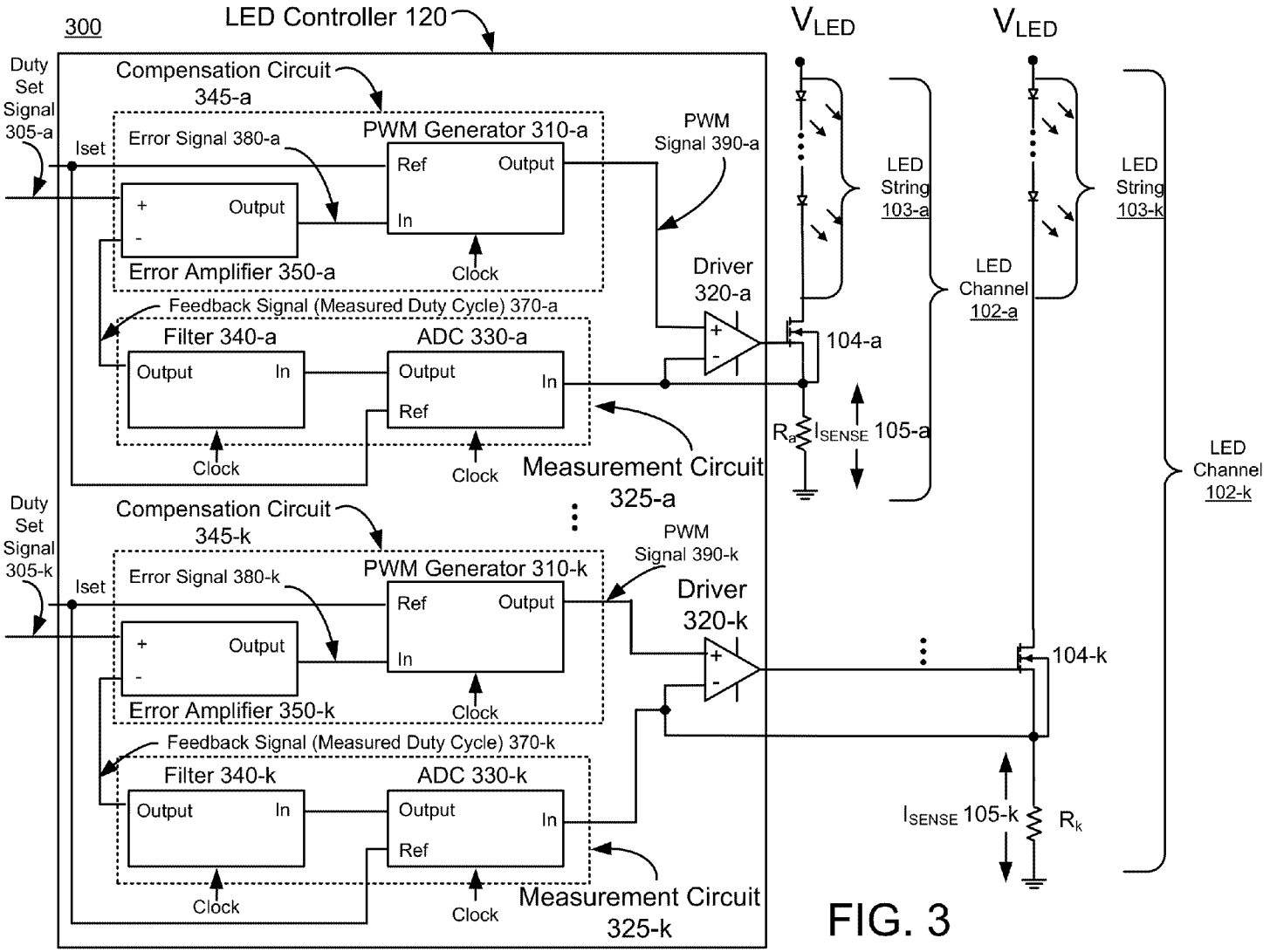
FIG. 3 illustrates a feedback configuration for regulating current through an LED string (and optionally matching brightness between LED strings) of a multi-channel LED system based on duty cycle feedback, according to one embodiment.

For example, FIG. 3 illustrates a feedback configuration 300 for matching brightness between LED strings in a multi-channel LED system based on duty cycle feedback, according to one embodiment.

As shown in configuration 300 in FIG. 3, the multi-channel LED system includes multiple LED channels, including LED channel 102-*a* and LED channel 102-*k*. LED controller 120 senses current through the sense resistor R (e.g., $R_a, \ldots, R_k$), which is indicative of current through the respective LED string 103 for each LED channel 102, as a voltage drop ($I_{SENSE}$) across the sense resistor R for that LED channel 102, and drives the gate terminal of the PWM transistor 104 for the respective LED channel 102 in order to control current through (e.g., and consequently, brightness of) the corresponding LED string 103. Furthermore, LED controller 120 regulates average current through the LED strings 103-*a* and 103-*k*, across one or more clock cycles or over a predetermined period of time, according to target or desired peak current and duty cycle levels (e.g., specified by Iset and Duty Set signals 305-*a* and 305-*k*) for LED channels 102-*a* and 102-*k*, respectively.

The LED controller 120 includes an LED driver to drive each of the LED channels based on a corresponding PWM (Pulse Width Modulation) drive signal. As illustrated in FIG. 3, the LED controller 120 includes a first LED driver 320-*a* to generate a first PWM (Pulse Width Modulation) drive signal to turn on or turn off a first current through a first LED string 103-*a* responsive to the first PWM drive signal 390-*a* and a second LED driver 320-*k* to generate a second PWM drive signal to turn on or turn off a second current through a second LED string 103-*k* responsive to the second PWM drive signal 390-*k*. In some instances, different drivers of the same multi-channel LED system may have different characteristics (e.g., different operating speeds). As shown in the waveforms of FIG. 5A, a driver that drives the first channel of FIG. 5A (e.g., driver 320-*a* of FIG. 3) is slower in speed of operation than a driver that drives the second channel of FIG. 5A (e.g., driver 320-*k* of FIG. 3). This mismatch in driver characteristics results in different or mismatched current levels and brightness levels between the LED strings driven by these drivers.

Thus, LED controller 120 further comprises a compensation circuit 345 for each LED channel that generates PWM signals 390 for each of the channel drivers (including PWM signal 390-*a* for driver 320-*a* and PWM signal 390-*k* for driver 320-*k*); duty cycles of the PWM drive signals are adjusted or modified to compensate for driver mismatches. For example, the compensation circuits 345-*a* and 345-*k* generate the first and second PWM drive signals 390-*a* and 390-*k*, respectively, responsive to first and second duty set signals 305-*a* and 305-*k*, respectively. The first duty set signal 305-*a* is indicative of a first duty cycle set for the first PWM drive signal 390-*a*, and the second duty set signal 305-*k* is indicative of a second duty cycle set for the second PWM drive signal 390-*k*.

Figure 5B:
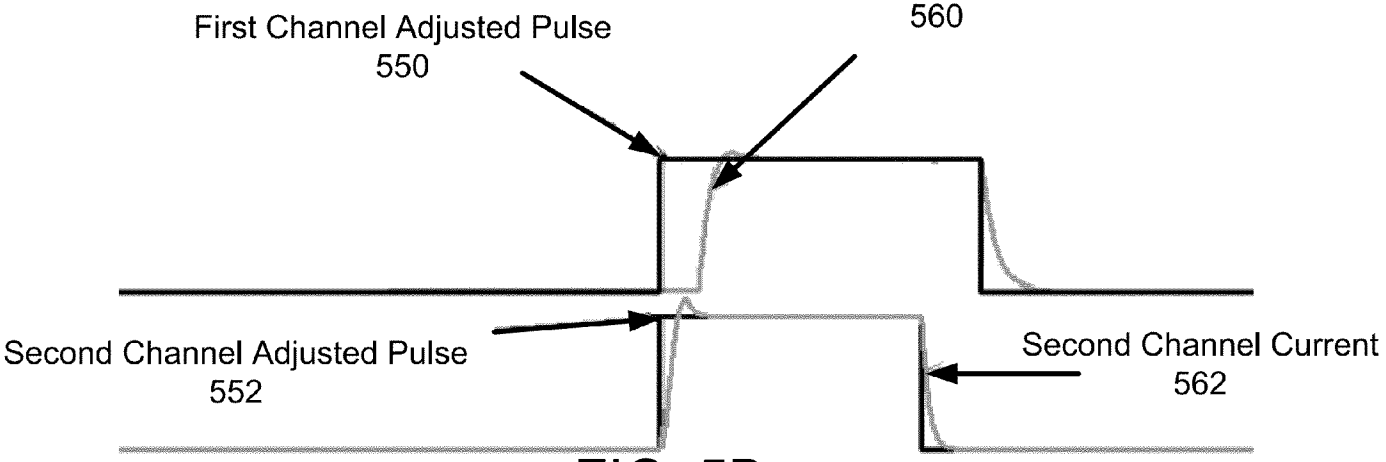

A PWM drive signal for any given channel is configured to have a duty cycle that corresponds to a duty set signal for that given channel, but further adjusted (increased or decreased) based on an error signal that represents a degree of current or brightness mismatch for that given channel. For example, if a first LED driver is slower than a second LED driver, then the first duty cycle of the first PWM drive signal is adjusted with respect to the first duty set signal to be greater than the second duty cycle of the second PWM drive signal adjusted with respect to the second duty set signal, while the first and second duty set signal have the substantially same value. Referring to FIGS. 5A-5B, if a first driver that drives the first channel of FIG. 5A (e.g., driver 320-*a* of FIG. 3) is slower in speed of operation than a second driver that drives the second channel of FIG. 5A (e.g., driver 320-*k* of FIG. 3), the PWM drive signal 390-*a* provided to the first driver 320-*a* has a greater duty cycle (e.g., first channel adjusted pulse 550 has a greater ON time, shown in FIG. 5B) than the duty cycle of the PWM drive signal 390-*k* provided to the second faster driver 320-*k* (e.g., second channel adjusted pulse 552 has a shorter ON time, shown in FIG. 5B). Thus, by adjusting the PWM pulse width or duty cycle, given a predetermined duty set values, based on an extent of mismatch between a predetermined target value and an actual measured value of duty cycle, the compensation circuit 345 for any given channel provides a desired or target current waveform (first channel current 560 or second channel current 562). Furthermore, by adjusting the PWM pulse width or duty cycle, given the same duty set values, based on an extent of mismatch, the compensation circuit 345-*a* and 345-*k* of different LED channels provide matched current waveforms between the different channels (first channel current 560 and second channel current 562) between the drivers and therefore can additionally provide inter-channel current and brightness matching.

To this end, each compensation circuit 345 comprises an error amplifier 350 (alternatively referred to herein as an error determination circuit 350) and a PWM Generator 310 (alternatively referred to herein as a PWM signal generation circuit 310). For example, as shown in FIG. 3, compensation circuit 345-*a* comprises an error amplifier 350-*a* and a PWM Generator 310-*a*; and compensation circuit 345-*k* comprises an error amplifier 350-*k* and a PWM Generator 310-*k*. The error determination circuit 350 for each channel receives a corresponding feedback signal representing current flowing through the respective LED channel. For example, error determination circuit 350-*a* receives a first feedback signal 370-*a* corresponding to LED channel 103-*a* and error determination circuit 350-*k* receives a second feedback signal 370-*k* corresponding to LED channel 103-*k* indicative of the first current and the second current, respectively. The error determination circuit 350 for each channel generates a corresponding error signal responsive to the feedback signal for that respective LED channel. Each error signal represents a measure of discrepancy between a predetermined target value (corresponding to a target average current value for the current through the channel) and actual measured current through the LED channel caused by driver characteristics or non-idealities for that LED channel. For example, as shown in FIG. 3, error determination circuit 350-*a* generates a first error signal 380-*a* (for LED channel 102-*a*) indicative of a difference between a predetermined target value (e.g., duty set signal 305-*a*) and the first feedback signal 370-*a*, and error determination circuit 350-*k* generates a second error signal 380-*k* (for LED channel 102-*k*) indicative of a difference between the predetermined target value (e.g., duty set signal 305-*k*) and the second feedback signal 370-*k*.

The PWM signal generation circuit 310 for each channel generates a PWM drive signal for that channel, each individual PWM drive signal 390 driving a corresponding LED driver 320. Referring to FIG. 3, the PWM signal generation circuit 310-*a* generates the first PWM drive signal 390-*a* to have the first duty cycle corresponding to the first duty set signal 305-*a* and further adjusted by the first error signal 380-*a*. Further, the PWM signal generation circuit 310-*k* generates the second PWM drive signal 390-*k* to have the second duty cycle corresponding to the second duty set signal 305-*k* and further adjusted by the second error signal 380-*k*.

In one or more embodiments, the first and second PWM signal generation circuits 310-*a* and 310-*k*, respectively generate the first and second PWM drive signals 390-*a* and 390-*k* to further have a predetermined peak magnitude value (Iset).

In this embodiment, the feedback signals 370 provided to each of the error amplifiers 350 for each LED channel 120 correspond to measured duty cycles of current flowing through that channel. In other words, the first feedback signal 370-*a* provided to error amplifier 350-*a* for the first LED channel 102-*a* represents measured duty cycle of current flowing through the first LED channel 102-*a* and the second feedback signal 370-*k* provided to error amplifier 350-*k* for the second LED channel 102-*k* represents measured duty cycle of current flowing through the second LED channel 102-*k*. In one or more embodiments, the LED controller 120 includes a measurement circuit 325 for each channel (e.g., measurement circuit 325-*a* for channel 102-*a* and measurement circuit 325-*k* for channel 102-*k*) to generate feedback signals (including the first and second feedback signals 370-*a* and 370-*k*) that represent measured duty cycle of currents through each of the LED channels by scaling input signals ($I_{SENSE}$) corresponding to the respective currents (including input signals 105-*a* and 105-*k* for channels 102-*a* and 102-*k*, respectively) by a predetermined scaling constant that is proportional to the predetermined peak magnitude value (Iset) for the PWM drive signals 390 (including first and second PWM drive signals 390-*a* and 390-*k*).

Each measurement circuit 325 comprises an analog to digital converter or ADC (e.g., a ADC 330-*a* for channel 102-*a* and ADC 330-*k* for channel 102-*k*, shown in FIG. 3) and, optionally, a digital filter 340 (including digital filter 340-*a* for channel 102-*a* and filter 340-*k* for channel 102-*k*). In some embodiments, ADCs 330-*a* and 330-*k* are Sigma Delta analog to digital converters. In some embodiments, ADC 330-*a* and 330-*k* generate the first and second feedback signals 370-*a* and 370-*k*, respectively, for the first and second LED channels 102-*a* and 102-*k*, respectively. This is accomplished by digitizing analog input signals $I_{SENSE}$ 105-*a* and 105-*k*, respectively, received from and representing current flowing through each of those respective LED channels. Each of the feedback signals 370 generated by the ADCs represents measured duty cycle of current through a respective LED channel 102. For example, the first and second feedback signals 370-*a* and 370-*k* represent measured duty cycle values (Measured Duty Cycle 370) of the currents through channels 102-*a* and 102-*k*, respectively. This is achieved by setting an input signal range of the ADC to have a predetermined value that is proportional to (or equal to) the predetermined peak magnitude value (Iset) of the PWM drive signals 390 for the respective channels.

The ADCs 330-*a*, 330-*k* for each channel receives analog signal $I_{SENSE}$ at the input (In) terminal and signal Iset at the reference (Ref) terminal, including input signals 105-*a* and 105-*k* for channels 102-*a* and 102-*k*, respectively.

The ADC Ref signal (Ref) sets the input dynamic range of an ADC. As shown in FIG. 3, if the target set point signal Iset is used as an ADC reference, then the ADC 330 generates or outputs digital signals corresponding to Measured Duty Cycles 370 for the respective LED channel. Digital output of ADC 330 (generated at Output terminal of ADC 330) is mathematically obtained as:

$$\text{Output}=\langle I_{SENSE}\rangle*\text{LSB}$$

where $\langle I_{SENSE}\rangle$ is a time average of signal $I_{SENSE}$ received at the In terminal of ADC 330, and LSB is the least significant bit or resolution of ADC 330.

By definition, LSB or resolution of the ADC is obtained by dividing number of ADC bits (Nbit) by the ADC Ref signal (Ref). Thus:

$$\text{Output}=\langle I_{SENSE}\rangle*\text{Nbit}/\text{Ref}$$

If the ADC Ref signal (Ref) is Iset (as shown in FIG. 3), then $$\text{Output}=\text{Nbit}*\langle I_{SENSE}\rangle/\text{Iset}$$

By definition, duty cycle of a waveform is a ratio of an on time ($T_{ON}$) of a pulse of the waveform to a total time period (T) of the waveform, which is also represented, in configuration 300, as:

$$\text{Duty Cycle}=T_{ON}/T=\langle I_{SENSE}\rangle/\text{Iset}$$

Thus, if the ADC Ref signal (Ref) is Iset, then Output of the ADC is mathematically a representation of the duty cycle (or Measured Duty Cycle 370). Therefore, corresponding to each channel, a respective ADC 330 converts the analog signal $I_{SENSE}$ to a digital representation at output terminal (Out) which is optionally received and processed by digital filter 340 to produce bandlimited (e.g., digitally low pass filtered) digital feedback signal Measured Duty Cycle 370 at the output (Out) terminal of filter 340 for that channel.

The feedback signals 370 for each of the individual LED channels representing Measured Duty Cycles 370 for the various channel currents are received by the corresponding Error Amplifier 350. Error Amplifier 350 for each channel compares each of the Measured Duty Cycles 370 with respective Duty Set Signals 305 (e.g., the desired or target duty cycle corresponding to each channel) to generate an error signal 380 for that respective channel (e.g., at the Out terminal of the Error Amplifier 350). The error signal 380 for a given channel is representative of a difference, over one or more clock cycles or over a predetermined interval of time (e.g., over 5 clock cycles or over a 10 millisecond duration), between the measured duty cycle and the target duty cycle of the current through that respective LED channel. For example, for the first LED channel 102-*a*, feedback signal 370-*a* is compared to duty set signal 305-*a* to generate an error signal 380-*a*. Similarly, for the second LED channel 102-*k*, feedback signal 370-*k* is compared to duty set signal 305-*k* to generate an error signal 380-*k*.

The PWM Generator 310 for each channel receives each of the error signals 380 at input (In) terminal of the PWM Generator 310 and the set point or target signal Iset at the reference (Ref) terminal of the PWM Generator 310. PWM Generator 310 generates a PWM signal 390 for the respective channel, that switches, for every switching cycle, between the set point value Iset and a voltage ground at a certain duty cycle. The duty cycle of each of the PWM signals 390 is, in turn, modified (e.g., relative to a set point duty cycle or relative to a value of duty cycle for a prior switching cycle for that LED channel) based on a value of error signal 380 for that respective LED channel. This adjustment in duty cycle is performed separately for the PWM signal that drives each channel. For example, for LED channel 102-*a*, the duty cycle of PWM signal 390-*a* is adjusted during a given switching cycle with respect to duty set signal 305-*a* based on a value of error signal 380-*a* of the prior switching cycle. Similarly, for LED channel 102-*k*, the duty cycle of PWM signal 390-*k* is adjusted during a given switching cycle with respect to duty set signal 305-*k* based on a value of error signal 380-*k* of the prior switching cycle. In some embodiments, the duty cycle of PWM signal 390 for a given LED channel is increased (e.g., relative to the target set point, Duty Set) if a value of the error signal 380 for that given LED channel is substantially non-zero and positive (e.g., if the Measured Duty Cycle 370 for that channel is lower than Duty Set Signal for that channel, as shown in FIG. 5A) until error signal 380 for that channel is reduced to zero or to a value below a predetermined threshold (e.g., until Measured Duty Cycle 370 is substantially equal to Duty Set for the channel).

Stated differently, in some embodiments, a width (or duty cycle) of the PWM signal 390 is adjusted for each individual LED channel 102 so as to minimize (e.g., to reduce to below a predetermined threshold, or to substantially null) an average measure of the error signal 380 for that channel over a predetermined period or interval of time.

Drivers 320-*a* and 320-*b* compare the PWM signals 390-*a* and 390-*b* with respective voltages $I_{SENSE}$ to generate control signals that drive the gates of PWM transistors 104-*a* and 104-*k* in order to maintain an $I_{SENSE}$ waveform that follows the corresponding PWM signals 390-*a* and 390-*b* (e.g., as shown in FIG. 5B). As explained above with reference to FIG. 2A, owing to a slow speed of operation (e.g., inadequate slew rate, driver propagation delay time, and so on), drivers 320 may be limited in their ability to provide a control signal to PWM transistor 104 that enables the voltage signal $I_{SENSE}$ to precisely follow PWM signal 390, particularly for low duty cycles.

However, as an improvement over the conventional configuration 200 of FIG. 2A, in configuration 300, a measure of the inability of drivers 320 to provide a signal $I_{SENSE}$ that tracks a target set point drive signal is measured (e.g., in the form of error signal 380 which represents a difference between a measured duty cycle of signal $I_{SENSE}$ and the desired or target duty cycle, Duty Set); and is compensated for by modifying a duty cycle of the PWM signal 390, that is provided to driver 320, based on the error signal 380, until the error signal 380 is substantially nulled or reduced to below a predetermined threshold.

Conversely, when the error signal 380 is substantially nulled by the compensation mechanism of configuration 300, the measured duty cycle of signal $I_{SENSE}$ is made substantially equal to the desired or target duty cycle (Duty Set) for the given LED channel 102. Furthermore, when this compensation mechanism of configuration 300 is similarly applied to each of the one or more LED channels 102 of the multi-channel LED system 100, the measured duty cycles of switching of each of the LED channels are matched to the common desired or target duty cycle Duty Set. For a substantially equal level of peak current (determined based on a commonly applied set point value of Iset) across the LED channels, the average currents through each of the LED channels 102 are sufficiently matched, thereby providing the desired channel-to-channel current and brightness matching.

In one embodiment, the error amplifier 350 is a proportional-integral (PI) type amplifier that integrates the error between the measured duty cycle and the target duty cycle over one or more clock cycles. In some embodiments, the Sigma-Delta ADC 330 is a continuous time sigma-delta ADC. Although the ADC 330 illustrated herein is described as a Sigma-Delta ADC (e.g., for hardware simplicity and ease of integration), in practice, various alternative ADC configurations can be used without departing from the scope of the disclosure. In some embodiments, the PWM Generator 310, Sigma-Delta ADC 330, and digital filter 340 are driven or synchronized by a Clock signal. In one embodiment, the Clock signal has a frequency of 20 MHz. In some embodiments, PWM signals 390 have a frequency between 20 kHz and 25 kHz (e.g., to exclude the human audible frequency band). In some embodiments, PWM signals 390 have a duty cycle between 1% and 100%. If the frequency of the Clock signal input to the PWM Generator 310 is 20 MHz and the frequency of a generated PWM signal 390 is 20 kHz, the resolution of the PWM Generator 310 is 0.1%. In some embodiments, if the frequency of the Clock signal received by PWM Generator 310 is not constant, but varies (e.g., due to dithering), PWM signal 390 is corrected for variability in the frequency of the Clock signal.

In some embodiments, current through an LED string during an ON time of its PWM drive signal 390 is between 20 mA and 200 mA. In some embodiments, average current through one or more LED strings 103 is matched within a predetermined current matching range, such as 1%, 2%, 5%, and the like. In some embodiments, brightness levels between LED strings 103 are matched within a predetermined brightness matching range, such as 1%, 2%, 5%, and the like.

LED Controller Feedback Configurations for Brightness Matching Across LED Strings Based on Average Current Feedback In alternative embodiments, a feedback configuration, in the multi-channel LED system, compensates for the driver mismatch by adjusting a duty cycle of a pulse width modulated (PWM) signal received by the driver to drive a corresponding LED string of the one or more LED strings, based on an error or discrepancy between a measured average current through the one or more LED strings (a product of measured peak current and measured duty cycle, impacted by the driver characteristics) and a desired set point or target value of average current that needs to be consistently maintained through the one or more LED strings to achieve the set point brightness level. By adjusting the duty cycle to reduce the error between the measured and target average current to a substantially zero value across the one or more channels, the average currents through the one or more LED channels are matched (and made substantially equal to the target or desired set point average current), resulting in channel-to-channel current and brightness matching.

Figure 4:
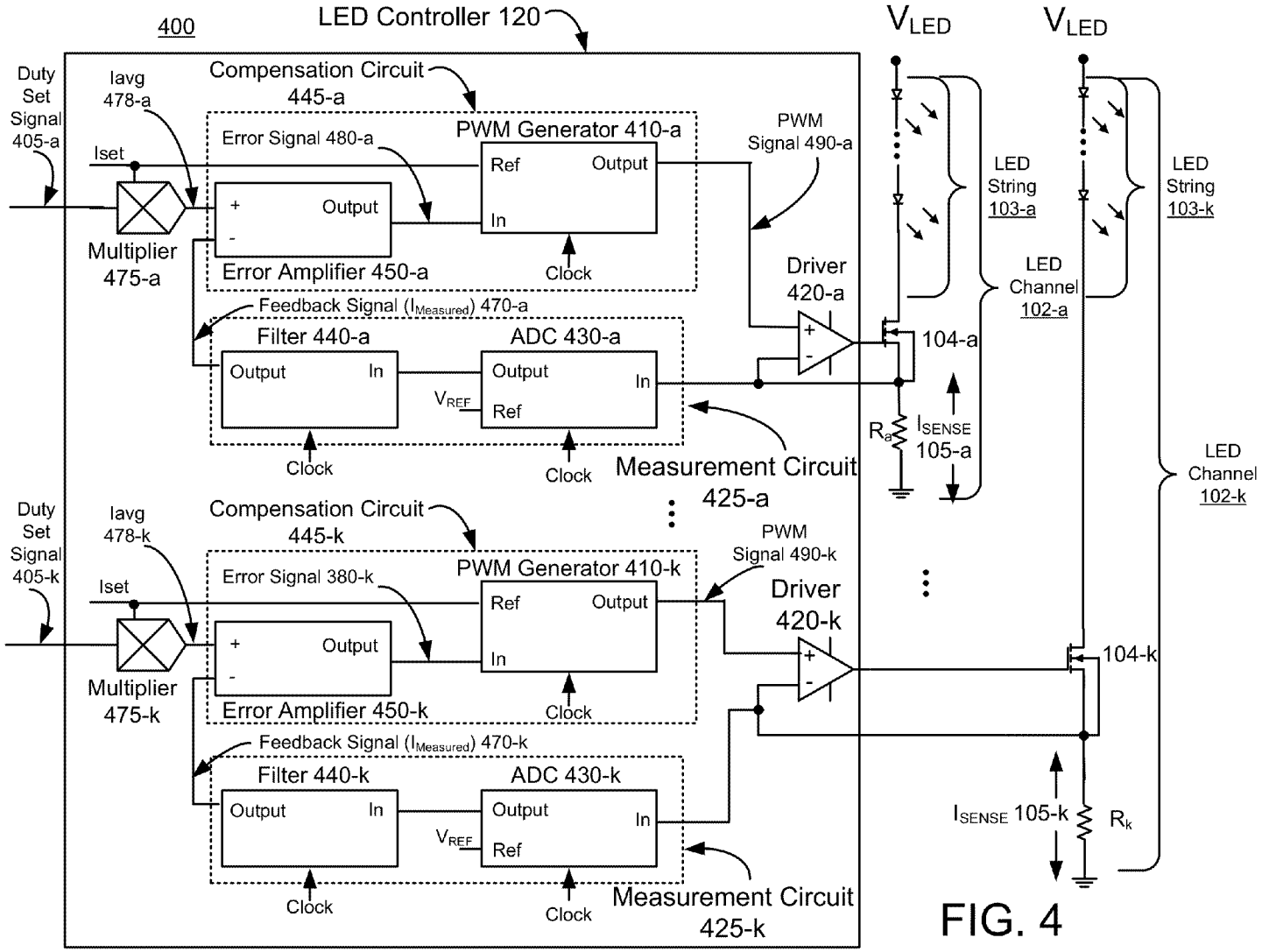
FIG. 4 illustrates a feedback configuration for regulating current through an LED string (and optionally matching brightness between LED strings) of a multi-channel LED system based on average current feedback, according to another embodiment.

For example, FIG. 4 illustrates a feedback configuration for regulating current through an LED channel (and optionally matching brightness between a plurality of LED strings) of a multi-channel LED system using average current feedback, according to another embodiment.

As shown in configuration 400 in FIG. 4, corresponding to LED channel 102-*a* and 102-*k*, LED controller 120 comprises drivers 420-*a* and 420-*k*, compensation circuits 445-*a* and 445-*k* (including PWM Generators 410-*a* and 410-*k*, and error amplifiers 450-*a* and 450-*k*), and measurement circuits 425-*a* and 425-*k*. Various properties of drivers 420-*a* and 420-*k*, compensation circuits 445-*a* and 445-*k* (including PWM Generators 410-*a* and 410-*k*, and error amplifier 450-*a* and 450-*k*), and measurement circuits 425-*a* and 425-*k* are similar or identical to corresponding properties of drivers 320-*a* and 320-*k*, compensation circuits 345-*a* and 345-*k* (including PWM Generators 310-*a* and 310-*k*, and error amplifiers 350-*a* and 350-*k*), and measurement circuits 325-*a* and 325-*k* described with reference to FIG. 3.

One difference between the configurations illustrated in FIGS. 3 and 4 is that in FIG. 4, the various feedback signals 470 (including the first and second feedback signals 470-*a* and 470-*k* corresponding to the first and second LED channels 102-*a* and 102-*k*, respectively) represent measured average current values corresponding to the currents flowing through the respective LED channels (including the first and second currents flowing through LED channels 102-*a* and 102-*k*, respectively), rather than the measured duty cycles. The measurement circuits 425-*a* and 425-*k* of FIG. 4 generate the respective feedback signals 470 for the corresponding LED channels (including the first and second feedback signals 470-*a* and 470-*k* for the first and second LED channels 102-*a* and 102-*k*) by scaling input signals corresponding to each of the respective channel currents (including input signals 105-*a* and 105-*k* for channels 102-*a* and 102-*k*, respectively) by a predetermined scaling constant that is distinct from and independent of the predetermined peak magnitude value (Iset) for the PWM drive signals 390 (e.g., the first and second PWM drive signals 390-*a* and 390-*k*).

To this end, each measurement circuit 425 includes an ADC 430 (including ADC 430-*a* for channel 102-*a* and ADC 430-*k* for channel 102-*k*) and optionally a digital filter 440 (including filter 440-*a* for channel 102-*a* and filter 440-*k* for channel 102-*k*). ADC 430 for each channel receives a fixed or constant reference voltage $V_{REF}$ that is distinct and, optionally, independent from the Iset voltage reference (used as the ADC reference in FIG. 3). Reference $V_{REF}$ shown in FIG. 4 therefore does not necessarily vary with variations in Iset. Since $V_{REF}$ sets the input analog signal range of the ADC, in configuration 400, the input signal range and resolution of the ADC have values (e.g., predetermined values) that are independent of the predetermined peak magnitude value (Iset) for the PWM drive signal 490.

Consequently, in configuration 400, for each of the LED channels in the multi-channel system (including the first and second channels 102-*a* and 102-*k*), the ADC 430 (and optionally Filter 440) generates or outputs a digital representation of the measured voltage drop across sense resistor $R_k$ due to measured average current through each LED channel as a digital feedback signal $I_{Measured}$ 470 for each LED channel, rather as than a digital representation of measured duty cycle of the current through each LED channel (explained previously with reference to configuration 300 of FIG. 3).

Accordingly, for each LED channel 102, error amplifier 450 receives a corresponding feedback signal ($I_{Measured}$) 470 and compares the feedback signal $I_{Measured}$ 470 for that channel with a target voltage drop across $R_k$ corresponding to target average current Iavg (e.g., obtained as a product of Iset and Duty Set for that channel, computed by Multiplier 475) for that channel. For example, as shown in FIG. 4, for the first channel 102-*a*, error amplifier 450-*a* compares feedback signal 470-*a* to the voltage signal representing target average current 478-*a* (obtained by multiplying Iset with Duty Set signal 405-*a*, from multiplier 475-*a*) to produce an error signal 480-*a*. Similarly, error amplifier 450-*k* compares for the second channel 102-*k*, feedback signal 470-*k* is compared to the voltage signal representing target average current 478-*k* (obtained by multiplying Iset with Duty Set signal 405-*k*, from multiplier 475-*k*) to produce an error signal 480-*k*. Each error Amplifier 480 similarly generates an error signal 480 for a corresponding channel, representative of a difference, over one or more clock cycles or over a predetermined interval of time, between the measured average current through that LED channel and the target average current through that LED channel, in the form of voltages.

Corresponding to each LED channel, PWM Generator 410 generates a PWM signal 490 that switches, for every switching cycle, between the set point value Iset and a voltage ground at a certain duty cycle; the duty cycle of each PWM signal 490 is, in turn, modified (e.g., relative to a set point duty cycle or relative to a value of duty cycle for a prior switching cycle) based on a value of error signal 480 for that given LED channel. In a manner analogous to that described with reference to configuration 300, the duty cycle of PWM signal 490 for a given channel is increased (e.g., relative to the target set point, Duty Set) if a value of the error signal 480 for that given channel is substantially non-zero and positive (e.g., if $I_{Measured}$ 470 is lower than Iavg for that given channel) until error signal 480 for the given channel is reduced to zero or to a value below a predetermined threshold (e.g., when $I_{Measured}$ 470 is substantially equal to Iavg for that given channel). In other words, the feedback mechanism of configuration 400 minimizes an average measure of the error signal 480 separately for each LED channel over a predetermined number of switching cycles or over a predetermined interval of time by adjusting a width (duty cycle) of PWM signal 490 for each separate LED channel.

Driver 420 for a given channel compares the PWM signal 490 for that channel with signal $I_{SENSE}$ corresponding to that channel, to generate a control signal that drives the gate of PWM transistor 104 of that channel in order to maintain an $I_{SENSE}$ waveform that follows PWM signal 490 (e.g., as shown in FIG. 5B) for that channel.

As an improvement over the conventional configuration 200 of FIG. 2A, in configuration 400, a measure of the inability of driver 420 to provide a signal $I_{SENSE}$ through a given LED channel that tracks a target set point drive signal is measured (e.g., in the form of error signal 480, which represents a difference between a measured voltage drop due to measured average current through the LED string 103 as a digital signal $I_{Measured}$ 470 and a target voltage drop across $R_k$ corresponding to target average current Iavg for that LED channel), and is compensated for by modifying a duty cycle of the PWM signal 490 that is provided to driver 420 of that LED channel, based on the error signal 480 for that LED channel, until the error signal 480 for that LED channel is substantially nulled or reduced to below a predetermined threshold.

Conversely, when the error signal 480 for any given LED channel is substantially nulled by the compensation mechanism of configuration 400, the measured voltage drop due to measured average current through that LED channel as a feedback signal $I_{Measured}$ 470 for that channel is made substantially equal to target voltage drop across $R_k$ corresponding to target average current Iavg for that given LED channel 102.

Furthermore, when this compensation mechanism of configuration 400 is similarly applied to each of the multiple LED channels 102 of the multi-channel LED system 100, the measured voltage drops due to measured average current through each of the LED strings 103 of each of the LED channels are matched to the common desired or target voltage drop across $R_k$ corresponding to target average current Iavg. Thus, the average currents through each of the LED channels 102 are sufficiently matched, thereby providing the desired channel-to-channel current and brightness matching.

It should be noted that PWM Generator 410, Driver 420, Analog to Digital Converter (e.g., Sigma Delta ADC 430), digital Filter 440, and Error Amplifier 450 described with reference to FIG. 4 may share one or more properties, respectively, of the PWM Generator 310, Driver 320, Analog to Digital Converter (e.g., a Sigma Delta ADC 330), digital filter 340, and Error Amplifier 350 described with reference to FIG. 3 herein. For brevity, these details are not repeated here.

The feedback configurations 300 and 400 of the described embodiments provide compensation for driver mismatches in the controller by adjusting, based on an extent of driver mismatch, the widths or duty cycles of Pulse Width Modulated (PWM) pulses that control the operation of the LED strings or of the current through the LED channel. For example, if a first LED driver operates at a first speed of operation and a second LED driver operates at a second speed of operation (greater than the first speed), the first duty cycle of the first PWM drive signal is adjusted with respect to the first duty set signal to be greater than the second duty cycle of the second PWM drive signal adjusted with respect to the second duty set signal, while the first and second duty set signal have the substantially same value. Such feedback configurations thus enable matching of average current between the one or more LED strings to provide improved uniformity or matching in brightness levels across the LED strings.

FIGS. 5A-5B illustrate comparative time traces of currents through two different LED channels of the multi-channel LED system, without feedback regulation (FIG. 5A) and with feedback regulation (FIG. 5B), according to some embodiments.

In FIG. 5A, the first channel and the second channel are configured to be controlled by drivers that are mutually mismatched in characteristics. As shown in FIG. 5A, owing to the driver mismatches between the first channel and the second channel, in the absence of feedback configurations 300 or 400, responsive to receiving identical control signals (represented jointly as target pulse 510 for a single operating cycle) a current flowing through the first channel (first channel current 520) is different from a current flowing through the second channel (second channel current 522). Accordingly, brightness of an LED string of the first channel would be different from or mismatched with respect to the brightness of an LED string of the second channel.

FIG. 5B includes examples of time traces illustrating a result of the feedback process (described with reference to FIG. 3 or FIG. 4 herein) to compensate for driver mismatch between the first and second channels, in order to match brightness between the LED strings of the first and second channels. As shown in FIG. 5B, duty cycles of the control signals provided to the first channel and the second channel are modified (represented as first channel adjusted pulse 550 and second channel adjusted pulse 552, for the given operating cycle) to compensate for the effects of driver mismatch between the first channel and second channel based on a degree of mismatch. Accordingly, current through the first channel and second channel (e.g., represented as first channel current 560 and second channel current 562) are substantially matched and are adjusted to be equivalent to the target or desired value of average current.

Upon reading this disclosure, those of skill in the art will appreciate still additional alternative designs for the multi-string LED system. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. An LED (Light Emitting Diode) controller comprising:

a first LED driver to generate a first PWM (Pulse Width Modulation) drive signal to turn on or turn off a first current through a first LED string responsive to the first PWM drive signal; and a first compensation circuit to generate the first PWM drive signal responsive to a first duty set signal, the first duty set signal being a first predetermined target duty cycle set for the first PWM drive signal, the first compensation circuit comprising:

a first error determination circuit to receive a first feedback signal indicative of the first current and to generate a first error signal indicative of a difference between a first predetermined target value and the first feedback signal; and a first PWM signal generation circuit to generate the first PWM drive signal to have the first duty cycle corresponding to the first duty set signal adjusted by the first error signal.

2. The LED controller of claim 1, further comprising:

a second LED driver to generate a second PWM drive signal to turn on or turn off a second current through a second LED string responsive to the second PWM drive signal; and a second compensation circuit to generate the second PWM drive signal responsive to a second duty set signal, the second duty set signal being a second predetermined target duty cycle set for the second PWM drive signal, the second compensation circuit comprising:

a second error determination circuit to receive a second feedback signal indicative of the second current and to generate a second error signal indicative of a difference between a second predetermined target value and the second feedback signal; and a second PWM signal generation circuit to generate the second PWM drive signal to have the second duty cycle corresponding to the second duty set signal adjusted by the second error signal.

3. The LED controller of claim 2, wherein:

the first LED driver operates at a first speed of operation;

the second LED driver operates at a second speed of operation, the second speed greater than the first speed; and the first duty cycle of the first PWM drive signal is adjusted with respect to the first duty set signal to be greater than the second duty cycle of the second PWM drive signal adjusted with respect to the second duty set signal.

4. The LED controller of claim 1, wherein:

the first predetermined target value corresponds to the first predetermined target duty cycle; and the first feedback signal represents a measured duty cycle value of the first current.

5. The LED controller of claim 4, wherein:

the first PWM signal generation circuit generates the first PWM drive signal to further have a predetermined peak magnitude value; and the LED controller further comprises an analog to digital converter (ADC) to generate the first feedback signal by digitizing an analog input signal corresponding to the first current, wherein an input signal range of the ADC is proportional to the predetermined peak magnitude value.

6. An LED (Light Emitting Diode) controller comprising:

a first LED driver to generate a first PWM (Pulse Width Modulation) drive signal to turn on or turn off a first current through a first LED string responsive to the first PWM drive signal;

a first compensation circuit to generate the first PWM drive signal responsive to a first duty set signal, the first duty set signal indicative of a first duty cycle set for the first PWM drive signal, the first compensation circuit comprising:

a first error determination circuit to receive a first feedback signal indicative of the first current and to generate, during a first switching cycle of the first PWM drive signal, a first error signal indicative of a difference between a first predetermined target value and the first feedback signal; and a first PWM signal generation circuit to generate the first PWM drive signal to have the first duty cycle corresponding to the first duty set signal and further adjusted by the first error signal, wherein, for a second switching cycle subsequent to the first switching cycle, based on the first error signal generated during the first switching cycle:

the first PWM signal generation circuit decreases the first duty cycle with respect to the first duty set signal, if the first feedback signal generated during the first switching cycle exceeds the first predetermined target value; and the first PWM signal generation circuit increases the first duty cycle with respect to the first duty set signal, if the first feedback signal generated during the first switching cycle is less than the first predetermined target value.

7. The LED controller of claim 1, wherein:

the first predetermined target value corresponds to a target average current value for the first current; and the first feedback signal represents a measured average current value corresponding to the first current.

8. The LED controller of claim 7, wherein:

the first PWM signal generation circuit generates the first PWM drive signal to further have a predetermined peak magnitude value; and the target average current value for the first current is a product of the predetermined peak magnitude value and the value of the first duty set signal.

9. The LED controller of claim 7, wherein:

the first PWM signal generation circuit generates the first PWM drive signal to further have a predetermined peak magnitude value; and the LED controller further comprises an analog to digital converter (ADC) to generate the first feedback signal by digitizing an analog input signal corresponding to the first current, wherein an input signal range and resolution of the ADC are independent of the predetermined peak magnitude value for the first PWM drive signal.

10. A method of controlling a Light Emitting Diode (LED) system including a first LED string, the method comprising:

generating a first PWM (Pulse Width Modulation) drive signal to turn on or turn off a first current through the first LED string responsive to the first PWM drive signal, the first PWM drive signal responsive to a first duty set signal, the first duty set signal being a first predetermined target duty cycle set for the first PWM drive signal, wherein generating the first PWM signal comprises:

receiving a first feedback signal indicative of the first current through the first LED string;

generating a first error signal indicative of a difference between a first predetermined target value and the first feedback signal; and generating the first PWM drive signal to have the first duty cycle corresponding to the first duty set signal adjusted by the first error signal.

11. The method of claim 10, wherein the LED system further comprises a second LED string, the method further comprising:

generating a second PWM drive signal to turn on or turn off a second current through the second LED string responsive to the second PWM drive signal, the second PWM drive signal responsive to a second duty set signal, the second duty set signal being a second predetermined target duty cycle set for the second PWM drive signal, wherein generating the second PWM signal comprises:

receiving a second feedback signal indicative of the second current through the second LED string;

generating a second error signal indicative of a difference between a second predetermined target value and the second feedback signal; and generating the second PWM drive signal to have the second duty cycle corresponding to the second duty set signal adjusted by the second error signal.

12. The method of claim 10, wherein:

the first predetermined target value corresponds to a target average current value for the first current; and the first feedback signal represents a measured average current value corresponding to the first current.

13. The method of claim 10, wherein:

the first PWM drive signal has a predetermined peak magnitude value; and generating the first feedback signal comprises digitizing via an analog to digital converter (ADC) an analog input signal corresponding to the first current, wherein an input signal range and resolution of the ADC are independent of the predetermined peak magnitude value for the first PWM drive signal.

14. The method of claim 10, wherein:

the first predetermined target value corresponds to the first predetermined target duty cycle; and the first feedback signal represents a measured duty cycle value of the first current.

15. The method of claim 10, wherein:

the first PWM drive signal has a predetermined peak magnitude value; and generating the first feedback signal comprises digitizing, via an analog to digital converter (ADC), an analog input signal corresponding to the first current, wherein an input signal range of the ADC is proportional to the predetermined peak magnitude value.

16. A method of controlling a Light Emitting Diode (LED) system including a first LED string, the method comprising:

generating a first PWM (Pulse Width Modulation) drive signal to turn on or turn off a first current through the first LED string responsive to the first PWM drive signal, the first PWM drive signal responsive to a first duty set signal indicative of a first duty cycle set for the first PWM drive signal, wherein generating the first PWM drive signal comprises:

receiving a first feedback signal indicative of the first current through the first LED string;

generating, during a first switching cycle of the first PWM drive signal, a first error signal indicative of a difference between a first predetermined target value and the first feedback signal; and generating the first PWM drive signal to have the first duty cycle corresponding to the first duty set signal and further adjusted by the first error signal, wherein, for a second switching cycle subsequent to the first switching cycle, based on the first error signal generated during the first switching cycle:

the first duty cycle is decreased with respect to the first duty set signal, if the first feedback signal generated during the first switching cycle exceeds the first predetermined target value; and the first duty cycle is increased with respect to the first duty set signal, if the first feedback signal generated during the first switching cycle is less than the first predetermined target value.

* * * * *